US007081860B2

(12) United States Patent
Schadler et al.

(10) Patent No.: US 7,081,860 B2
(45) Date of Patent: Jul. 25, 2006

(54) FOLDED BROADCAST PANEL ANTENNA SYSTEM AND METHOD

(75) Inventors: John L. Schadler, Raymond, ME (US); Andre Skalina, Portland, ME (US)

(73) Assignee: SPX Corporation, Charlotte, NC (US)

( * ) Notice: Subject to any disclaimer, the term of this patent is extended or adjusted under 35 U.S.C. 154(b) by 63 days.

(21) Appl. No.: 10/926,998

(22) Filed: Aug. 27, 2004

(65) Prior Publication Data

US 2006/0033672 A1 Feb. 16, 2006

Related U.S. Application Data

(63) Continuation-in-part of application No. 10/914,092, filed on Aug. 10, 2004.

(51) Int. Cl.
*H01Q 13/10* (2006.01)

(52) U.S. Cl. ..... 343/767; 343/770

(58) Field of Classification Search ..... 343/767, 343/770, 815

See application file for complete search history.

(56) References Cited

U.S. PATENT DOCUMENTS

| | | | | |
|---|---|---|---|---|
| 3,623,162 | A * | 11/1971 | Whitty | 343/767 |
| 4,062,019 | A | 12/1977 | Woodward et al. | 343/797 |
| 4,583,098 | A | 4/1986 | Sikina, Jr. | 343/771 |
| 4,590,480 | A * | 5/1986 | Nikolayuk et al. | 343/771 |
| 4,899,165 | A | 2/1990 | Schadler | 343/767 |
| 6,424,309 | B1 * | 7/2002 | Johnston et al. | 343/767 |
| 6,762,729 | B1 * | 7/2004 | Egashira | 343/767 |
| 6,762,730 | B1 * | 7/2004 | Schadler | 343/770 |
| 2004/0130499 | A1 * | 7/2004 | Weiss | 343/795 |

* cited by examiner

*Primary Examiner*—Tho Phan
(74) *Attorney, Agent, or Firm*—Baker & Hostetler LLP

(57) ABSTRACT

An antenna system and method using a folded panel antenna system with a bow-tie slot formed therein is arranged about a tower to provide greater azimuthal beamwidth coverage with increased gain. A groundplane is positioned to the rear of the folded panel, wherein a stripline feed is utilized for exictation of the antenna. A skewed parasitic dipole is attached to the front of the bow-tie slot to generate orthogonal field components for circular and/or ellipitic polarizations.

20 Claims, 11 Drawing Sheets

FOLDED BROADCAST PANEL ANTENNA SYSTEM AND METHOD

This application claims priority to and is a continuation-in-part of U.S. patent application entitled, "Circularly Polarized Broadcast Panel System and Method Using a Parasitic Dipole," by John Schadler, filed Aug. 10, 2004 having a Ser. No. 10/914,092, the disclosure of which is hereby incorporated by reference in its entirety.

FIELD OF THE INVENTION

The present invention relates generally to panel antennas having broadened patterns. More particularly, the present invention relates to a slotted multi-panel antenna system and method having a folded panel and fed by a stripline. The panel antenna can provide a uniform polarization, or circular polarization by use of an off-axis parasitic dipole element.

BACKGROUND OF THE INVENTION

Slotted antenna systems are well known in the art as providing radiation patterns similar to dipole antennas, wherein antennas using a slot or a series of slots in a flat, electrically large surface are typically referred to as panel antennas. Panel antennas having a bow-tie shaped slot are known to be multi-band (based on the width and shape of the bow-tie). However, bow-tie panel antennas are typically limited in beamwidth due to the panel's shielding effect. Also, panel antennas, in general, are not capable of providing circularly polarized fields.

Therefore, there has been a longstanding need in the antenna community for a systems and methods for a panel antenna that have a greater flexibility of beamwidth and, additionally, provide circularly-polarized electromagnetic radiation.

SUMMARY OF THE INVENTION

The foregoing needs are met, to a great extent, by the present invention, wherein in some embodiments a folded panel antenna system is provided with a bow-tie slot formed therein. A ground plane is positioned to the rear of the folded panel, wherein a stripline feed is utilized for exictation of the antenna. By judicious arrangement of the antenna system, greater beamwidth coverage with increased gain can be accomplished.

In accordance with another embodiment of the present invention, a doublet panel antenna is provided, comprising at least one or more conductive panels having a bow-tie slot therein, wherein portions of the panels are folded to form a multi-angled panel, the junction formed by the folded portions of the panels with the non-folded portions of the panels being substantially parallel to a centerline of the bow-tie slot, a substantially planar ground plane disposed behind the panels and coupled to a side of the bow-tie slot, and a stripline feed disposed between the panels and the ground plane, wherein the stripline feed is coupled to an opposite side of the bow-tie slot.

In accordance with yet still another embodiment of the present invention, a slotted panel antenna is provided comprising, a folded radiating means for radiating a predominant first electromagnetic field orientation, an unshielded excitation means for exciting currents on the folded radiating means, a parasistic radiating means for radiating predominant second electromagnetic field orientation, an imaging means for providing a ground plane effect, and a grounding means for providing a ground path from the folded radiating means to a ground, wherein the parasitic radiating means is disposed substantially parallel to and displaced from a front plane of the folded radiating means, and oriented at an angle that is skewed from an axis of symmetry of the folded radiating means and a midpoint of the folded radiating means substantially crosses the axis of symmetry, and the imaging means is disposed substantially parallel to the folded radiating means and on an opposite face of the folded radiating means from the parasitic radiating means.

In accordance with yet still another embodiment of the present invention, a method for broadcasting an electromagnetic signal is provided, comprising the steps of, folding portions of a bow-tie slotted panel radiator to increase the beamwidth from the panel radiator, placing a ground plane behind the radiators, arranging the panel radiators about a tower, and exciting a first electromagnetic field from each of the folded slotted panel radiators via a stripline feedline.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DRAWINGS

Figure 1:
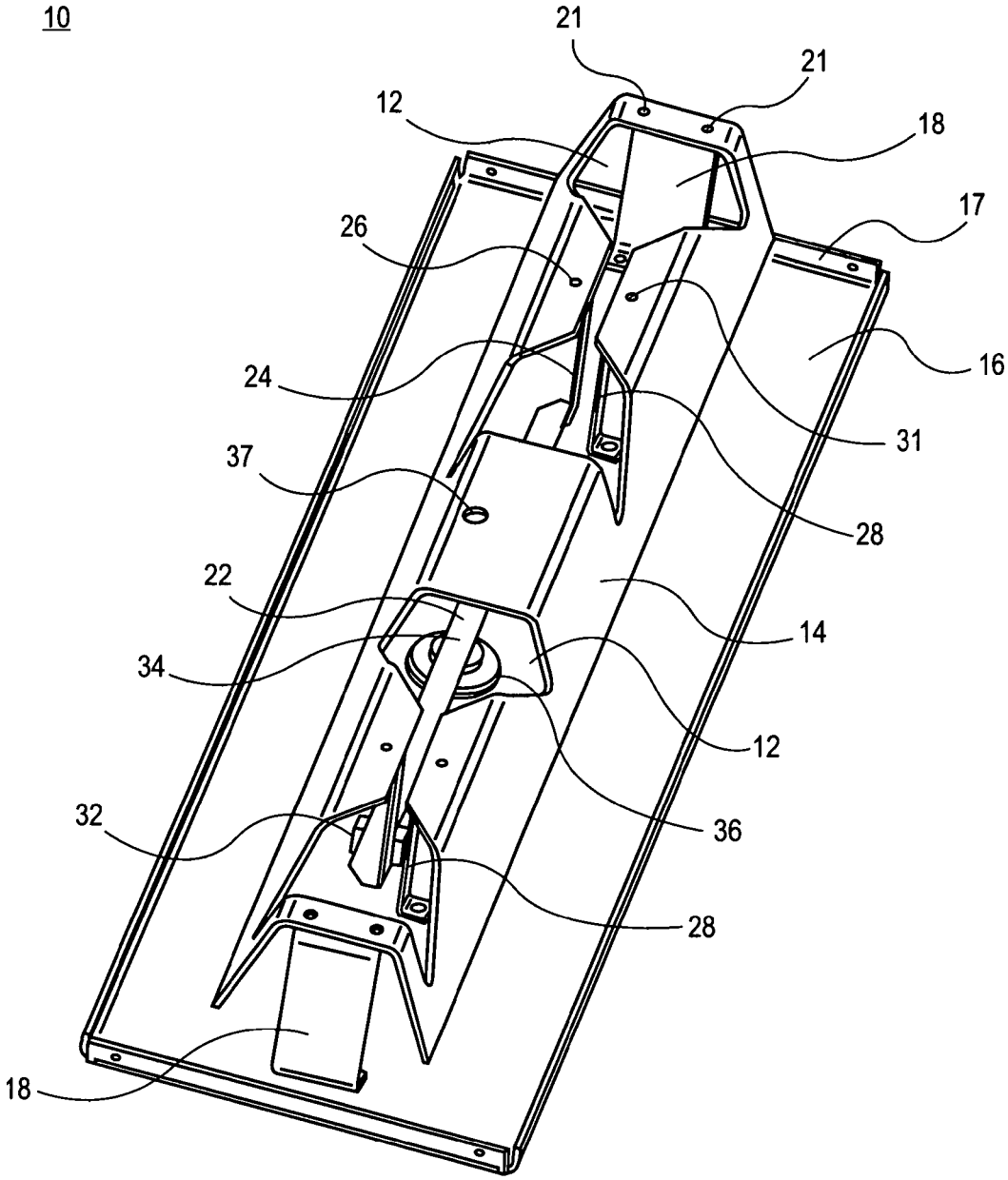
FIG. 1 is a perspective illustration of exemplary bow-tie folded panel antenna system according to the invention.

The invention will now be described with reference to the drawing figures, in which like reference numerals refer to like parts throughout.

Due to the planar structure of a panel antenna, it is well known that panel antennas generally provide lobed radiation patterns and, of themselves, do not form broad beam patterns. For a panel antenna, without a ground screen behind it, the pattern is bi-lobal having a lobe in each "East" and "West" hemisphere. Typically, when trying to generate an omni-directional pattern using panel antennas, the panel antennas, with ground planes placed behind them, are circularly arranged resulting in a radial array of panel antennas. When equally phased, the composite of the lobes of the individual panel antennas form an omni-directional pattern. Due to the natural lobbing of the individual panel antennas, a non-insignificant number of panel antennas are required, as well as the attendant feed structures.

An elegant approach to forming an omni-directional pattern is discussed in U.S. Pat. No. 6,762,730, titled "Crossed Bow-tie Slot Antenna," by the present inventor, the disclosure of which is hereby incorporated by reference in its entirety. This approach superimposes bow-tie slot panels in separate planes of azimuth to form complementary electromagnetic field vectors from the independent slot panels. Principally, two panel antennas are orthogonally placed and equally phased, resulting in a near omni-directional pattern. However, the antenna system discussed in U.S. Pat. No. 6,762,730 only provides a unitary polarization and, as additional panels are superimposed for better omni-directional pattern forming, coupling between the feed structures can become a concern. Herethereto, there has not been developed an antenna system that provides circularly polarized, omni-directional radiation using a nominal set of panel antennas.

FIG. 1 is a prospective front view of a doublet panel antenna 10 according to an exemplary embodiment of this invention, having an increased beamwidth in azimuth. The doublet panel antenna 10 is illustrated in FIG. 1 as containing two collinear bow-tie slots 12 formed in a folded panel 14, the folded panel 14 having symmetrical folds parallel to the centerline of the slots 12. The folds of the folded panel 14 are illustrated in FIG. 1 as being folded "rearward," however, they may be folded "forward," according to engineering or pattern control preference. The folded panel 14 is displaced from a ground plane 16 via supports 18 situated at the axial ends of the folded panel 14. The supports 18 are attached to the folded panel 14 via attachment holes 21 in the folded panel 14, either by friction coupling, screws, or any means suitable for attaching the folded panel 14 to the supports 18.

In the exemplary embodiments described herein, the angle formed by the folded portions of the folded panel 14 is approximately 70 degrees from the front face of the folded panel 14. As will be explained in the foregoing, based on the angle chosen, the amount of broadening of the beamwidth can be adjusted within some limited degree, before radiation efficiencies and other considerations render the fold to be less effective.

The ground plane 16 is illustrated in FIG. 1 as being a solid planar rectangular structure, encompassing the entire rear of the folded panel 14, and having raised lips 17 around its perimeter to facilitate attachment to a radome (not shown). However, it should be appreciated that the ground plane 16 may be lipless and, based on the frequencies of operation, the ground plane 16 may be non-solid, being perforated for weight and wind loading considerations. Further, the ground plane 16 may be of a non-rectangular form and, additionally, folded in a like or similar manner to that of the folded panel 14.

Currents on the doublet panel antenna 10 are induced by stripline 22, uniformly displaced from the ground plane 16 by non-conducting supports 32, via vertical conduits 24 coupled to one side 26 of the folded panel 14. The vertical conduits 24 are facilitated to the folded panel 14 at opposite ends of the stripline 22. Symmetrically located, about the stripline 22 are ground-path providing vertical conduits 28 which are coupled to the ground plane 16 and to the other side 31 of the folded panel 14. Generally, the vertical conduits 24 and 28 operate as electrical duals, and are configured to provide substantially equal current paths to the sides 26 and 31 of the folded panel 14. It should be appreciated, however, that the conduits 24 and 28 do not necessarily have to be vertical, as they may be placed at some angle from the stripline 22 and ground plane 16, respectively. Moreover, they may be, according to design preference, placed non-symmetrically about the folded panel 14. Additionally, the stripline 22 may extend beyond the conduits 24 and 28, as well as tuning of the stripline may be accomplished by tuning discs or elements (not shown) placed along the stripline 22 or ground plane 16. It should be appreciated that while FIG. 1 illustrates the stripline feed 22 as a uniform transmission line, a non-uniform or meandering line may be used according to design preference.

The stripline 22 is fed by a feed junction 34, preferably, but not necessarily, located at a midpoint of the stripline 22. The feed junction 34 may comprise a center conductor coaxial connection, wherein the ground portion of the coaxial connection is coupled to the ground plane 16 via ground connection 36. In the exemplary embodiments, the reverse of the ground connection 36 is coupled to a standard 7/16" DIN or Type N connector. Of course, alternative connectors may be used according to design specifications.

The stripline 22 and vertical conduits 24 and 28 provide a convenient mechanism for feeding the bow-tie slots 12. Specifically, due to the folded arms of the folded panel 14, use of a coaxial feed line, as an excitation source across the slot 12, will require an abrupt change in the orientation of the coaxial feed (e.g., from vertical to horizontal) which can be difficult to acquire without inducing mismatches at the slot 12 junction. The use of a stripline 22 alleviates this difficulty.

Mounting hole(s) 37 are provided about the front face of the folded panel 14 to facilitate mounting of a radome (not shown), to protect the doublet panel antenna 10. Additional mounting holes may be placed about the face of the folded panel 14, preferably at regions of low current density, for example, the center or ends of the folded panel 14.

Figure 2:
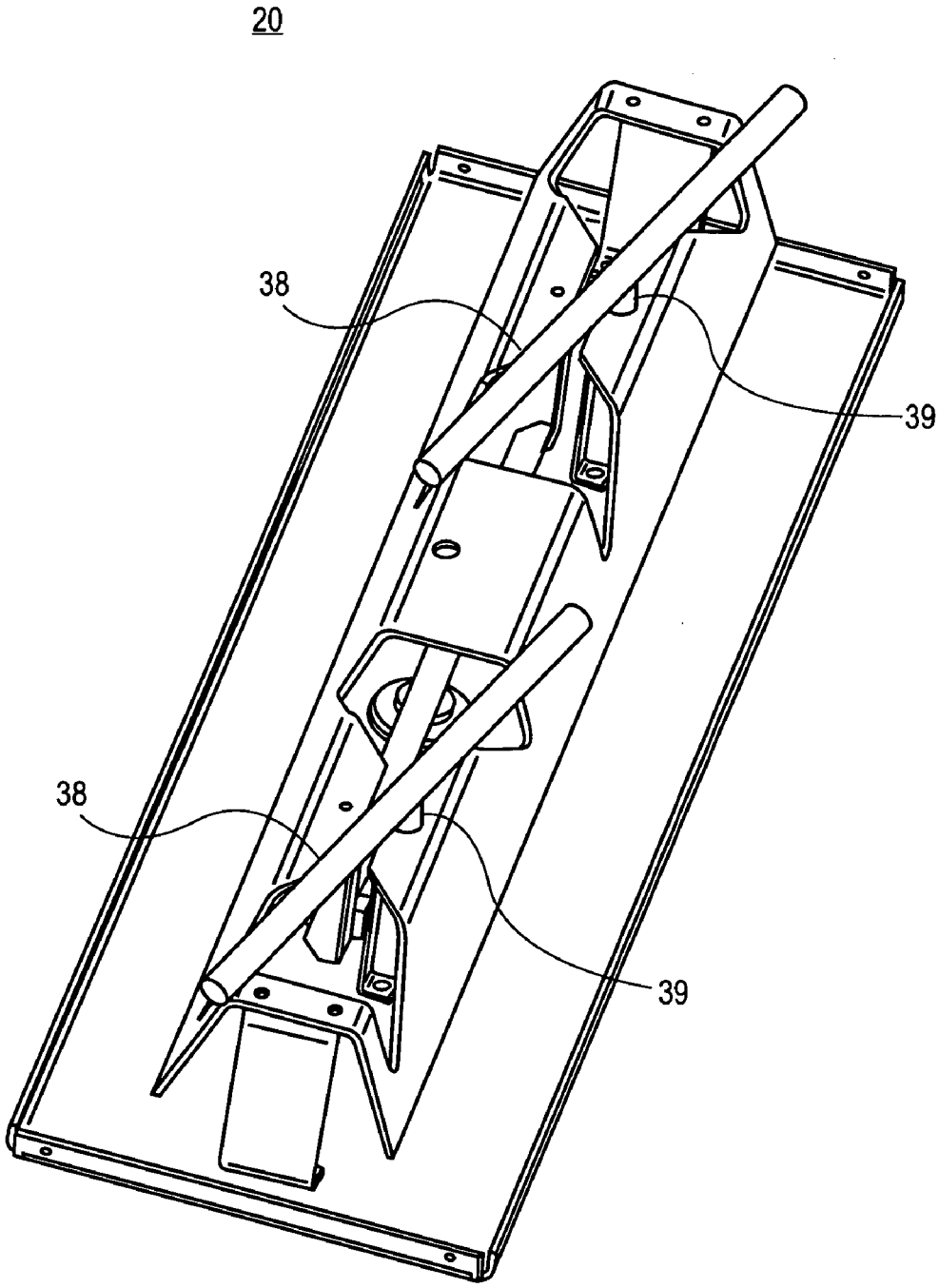
FIG. 2 is another perspective illustration of the exemplary antenna system of FIG. 1 with a parasitic element.

FIG. 2 is an illustration of the doublet panel antenna 10 of FIG. 1 configured with parasitic dipoles 38 to facilitate orthogonal polarizations. As discussed in U.S. patent application "Circularly Polarized Broadcast Panel System and Method Using a Parasitic Dipole," filed Aug. 10, 2004, by the present inventor, coupling will occur between the horizontal fields emanating from the slots 12 and the skewed parasitic dipoles 38. The coupled energy will be re-oriented by the parasitic dipole 38 from the horizontal plane to the "skewed" plane. Due to the skewed orientation of the parasitic dipoles 38, a vertical radiating field component will be generated which complements the horizontal component from the bow-tie slots 12. Based on the coupling efficiency of the parasitic dipoles 38 to the slots 12, and the orientation/distance of the parasitic dipoles 38 from the face of the slots 12, varying amounts of vertical or orthogonal field components can be generated. By adjusting at least one of the above attributes of the parasitic dipoles 38, an increasing or decreasing amount of the orthogonal field component can be generated. With the generation of orthogonal field components, circular polarization can be obtained as well as elliptic polarization.

It should be appreciated that while FIG. 2 illustrates the parasitic dipoles 38 as being affixed to the folded panel 14 via a single non-conductive support 39, there may be a plurality of supports 39 for each of the parasitic dipoles 38. The supports 39 can be attached to the parasitic dipoles 38 in any number of ways, including, but not limited to, epoxy, friction couplings, screws, etc. Manipulation of the offset or skew angle of the parasitic dipoles 38 may be accomplished by rotating the parasitic dipoles 38 about its supports 39 or by moving the supports 39.

Due to the off-broadside orientation of the folded arms of the folded panel 14, the fields generated across the folded arms of the folded panel 14 will propagate off-broadside, spreading the width of the pattern from its conventional lobe-like pattern. The off-broadside radiation is further broadened by the reduced aperture formed by the folded arms of the folded panel 14, of the bow-tie slot 12. Due to the reduced aperture, an attendant reduction of the radiation efficiency will occur for those wavelengths that are off-broadside radiated. However, a degree of compensation is acquired through constructive interference from the "paired" bow-tie slot 12. By utilizing a pair of bow-tie slots 12, as shown in the panel antennas 10 and 20, of FIGS. 1 and 2, and feeding the panel antennas 10 and 20 with a stripline feed, a broad beamed, high gain multi-frequency antenna system is obtained.

Because of the folding of the arms of the folded panel 14, it may be necessary for the parasitic dipoles 38 to be reconfigured to have "lowered" ends, that are parallel to the folded arms, to enable more efficient coupling to the off-broadside fields. That is, the ends of the parasitic dipoles' 38 arms can be bent to form an upside down "U."

Figure 3:
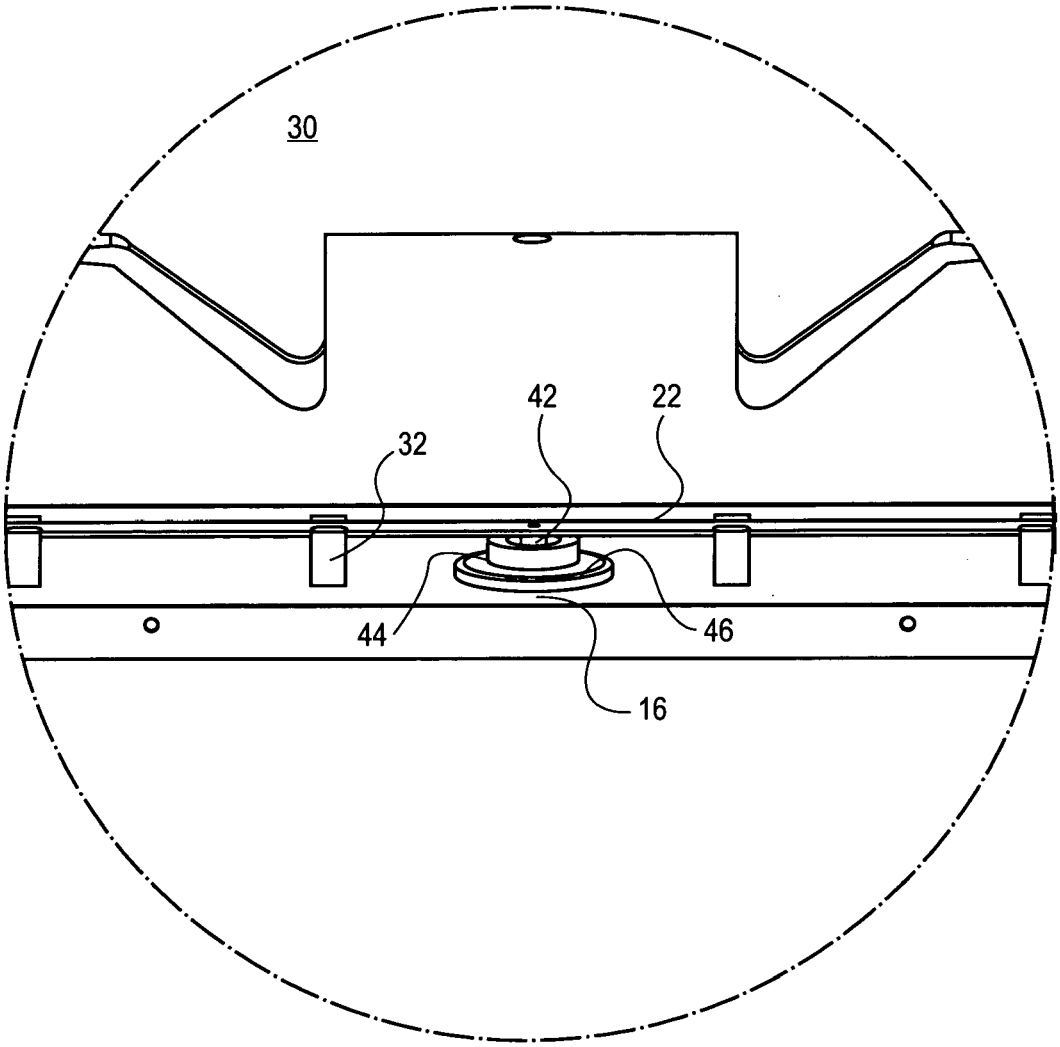
FIG. 3 is a close-up illustration of the exemplary stripline feed structure.

FIG. 3 is a close-up illustration of the coax-to-stripline junction 30 of FIGS. 1 and 2. FIG. 3 illustrates the center conductor 42 protruding from an outer shield 44 to engage the stripline 22 for conduction of currents. The engagement of the center conductor 42 to the stripline 22 may be accomplished by welding, brazing, crimping, or any method capable of fixing the center conductor 42 to the stripline 22. The outer shield 44 is pared away from the center conductor 42 and is fixed to a supporting ring 46. The supporting ring 46 secures the outer shield 44 to the ground plane 16. The center conductor 42, outer shield 44 and supporting ring 46 may be a single unit, corresponding to a connection piece of a connector kit. Supports 32 are shown supporting the stripline 32 above the ground plane 16. The supports 32 are non-conductive and may be adjustable in location and height, according to design preference.

Figure 4:
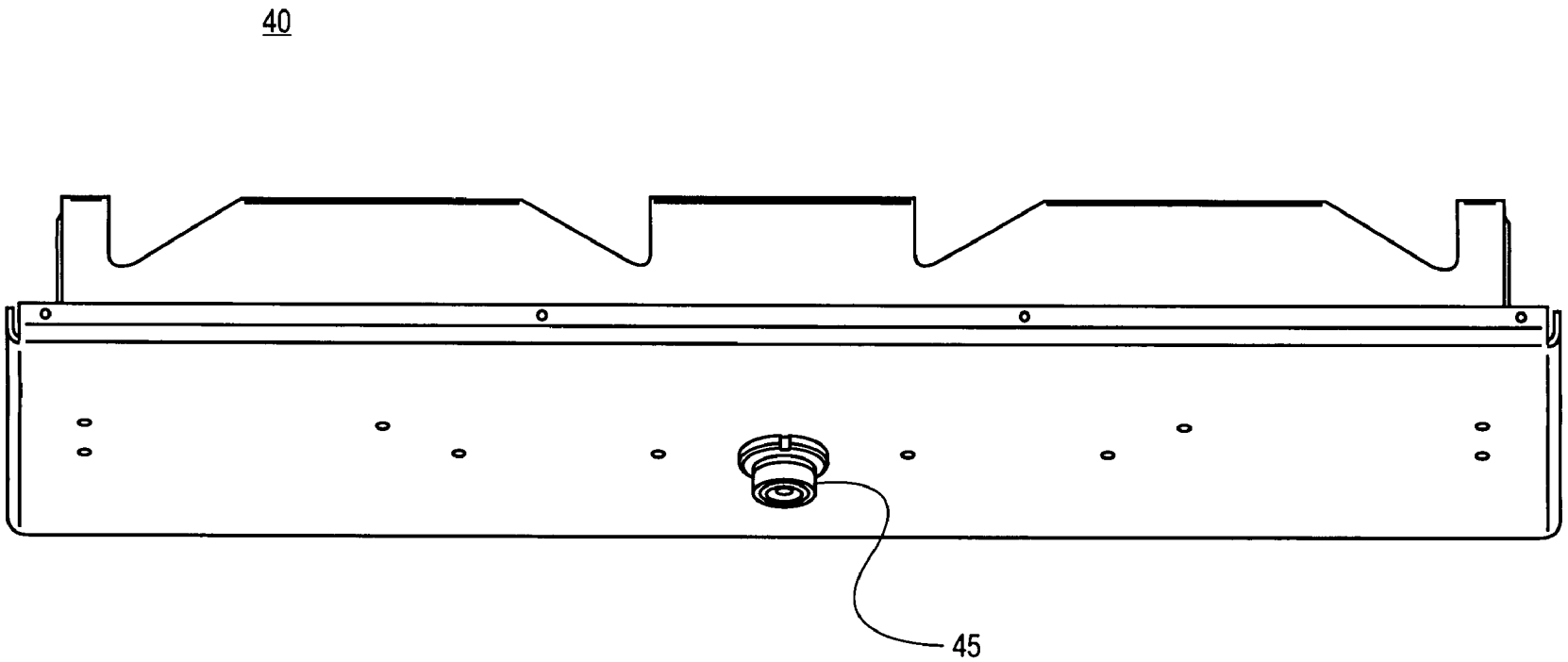
FIG. 4 is a rear illustration of the exemplary antenna system.

FIG. 4 is an exemplary illustration 30 of the rear of doublet panel antennas 10 and 20. Positioned at the back of the ground plane 16 is a connector 45 for connecting the coax-to-stripline junction 30 to a feed line (not shown) which is in turn connected to a transmitter (also not shown). The connector 45 may be of a conventional type, having a screw-on or pressure fitted lock, for example, a 7/16" DIN or Type N connector, or specially configured for coupling a feed line to the panel antenna. Mounting connectors or brackets (not shown) may be placed on the back of the ground plane 16 to enable attachment of the doublet panel antennas 10 and 20 to a tower or mast.

Figure 5:
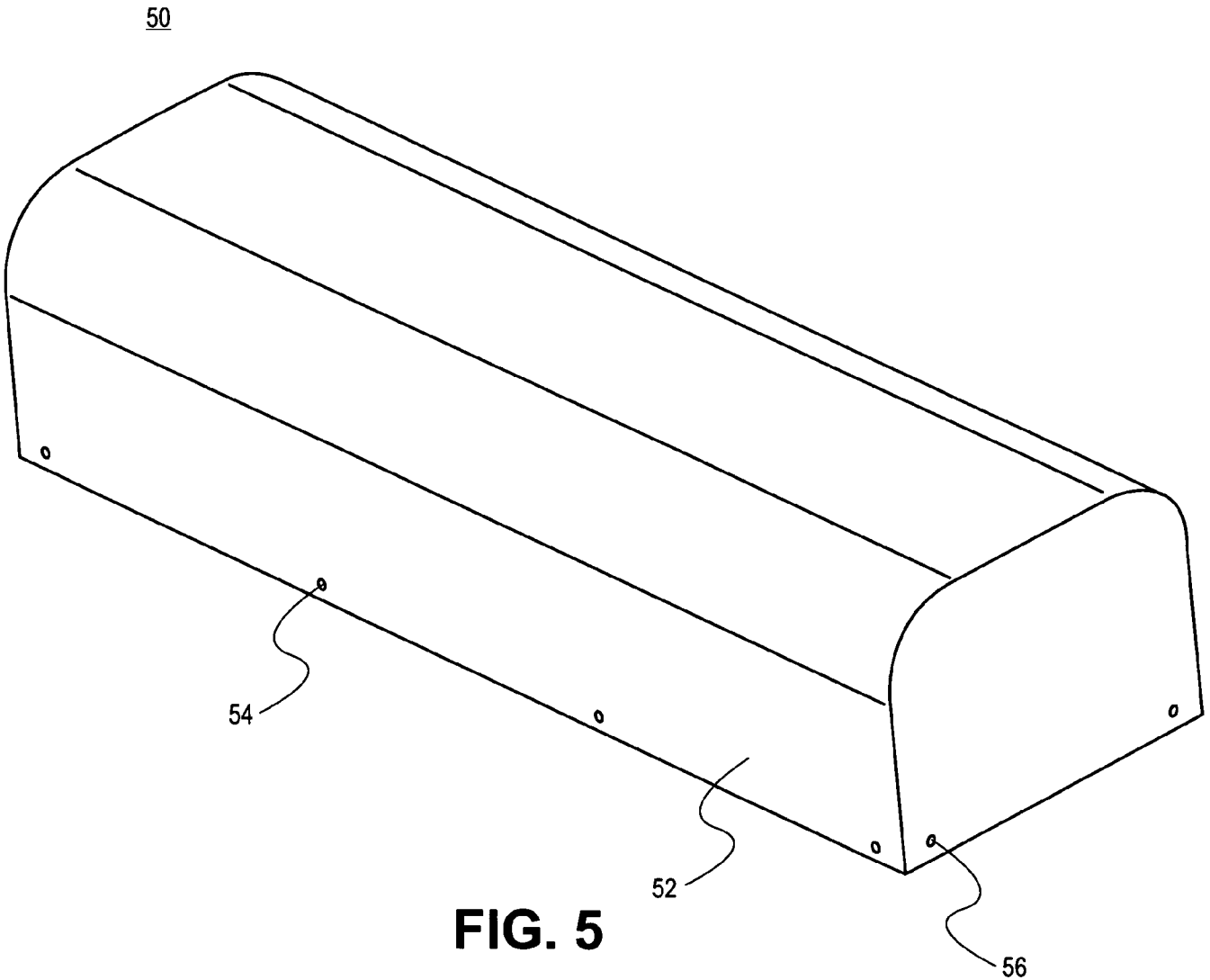
FIG. 5 is a perspective illustration of the exemplary antenna system with a radome installed.

FIG. 5 is an illustration 50 of the exemplary embodiments with a radome 52 installed. The radome 52 is fitted to the ground plane 16 raised lips 17 (obscured from view). Optional mounting holes 54 and 56 are positioned about the periphery of the radome 52 to facilitate the mounting of the radome 52 to the ground plane 16. The radome 52 is form-fitted to provide a compact structure for the doublet panel antennas 10 and 20 to fit in. As can be apparent from the compact structure, the doublet antenna can be situated in a vertical axis or horizontal axis, or tilted therebetween, without requiring any reconfiguration of the antenna.

Based on the various exemplary embodiments described herein, experimental tabulations have been performed for a doublet panel antenna designed for the upper and lower 700 MHz band. A maximum VSWR of 1.1:1 has been demonstrated for frequencies ranging from 698 MHz to 747 MHz. Using, for example, a 7/16" DIN input connector, and a panel antenna designed for the upper and lower 700 MHz band, a power rating of 1 kW can be obtained for vertical, horizontal, or circular polarization. As will be demonstrated in the following Figures, customized azimuth patterns can be cost effectively obtained.

Figure 6B:
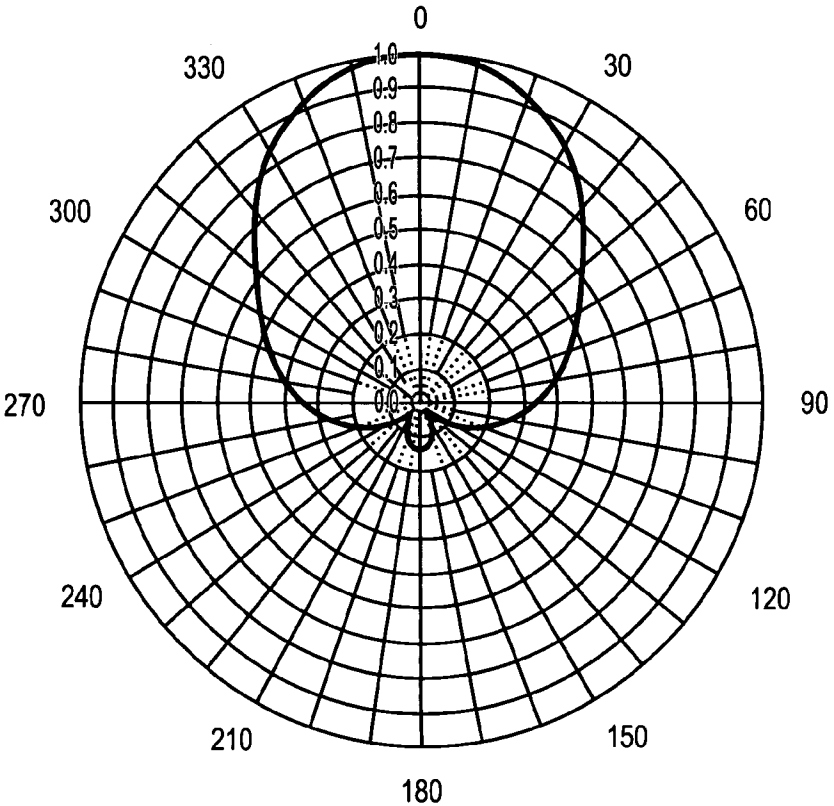
FIGS. 6A–6B illustrate a sample configuration of the exemplary antenna system and the resulting azimuthal pattern.
Figure 6A:
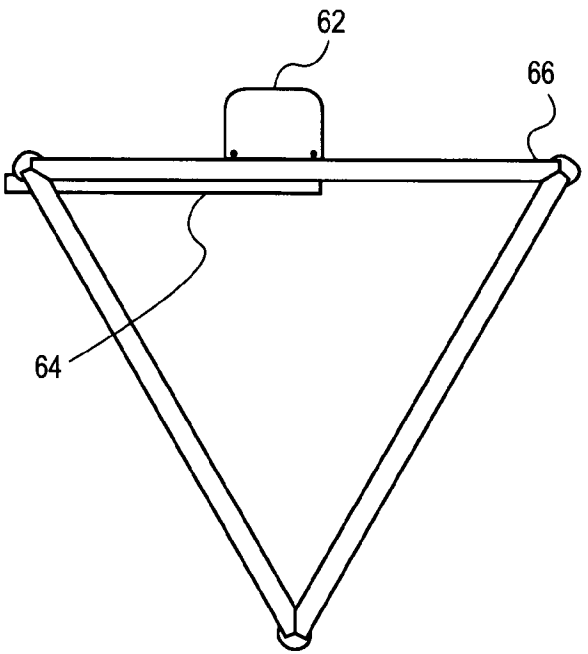

FIG. 6A is an illustration of an exemplary doublet panel antenna 62 with a feedline 64 configured vertically on one face of a tri-faced tower 66.

FIG. 6B is an azimuthal pattern plot of the configuration of FIG. 6A. As can be seen from FIG. 6B, the half-power beamwidth is between 88 degrees and 92 degrees. This beamwidth reflects an increase in azimuth of approximately 33 percent over conventional bow-tie slot panel antennas, similarly located on a tower.

Figure 7B:
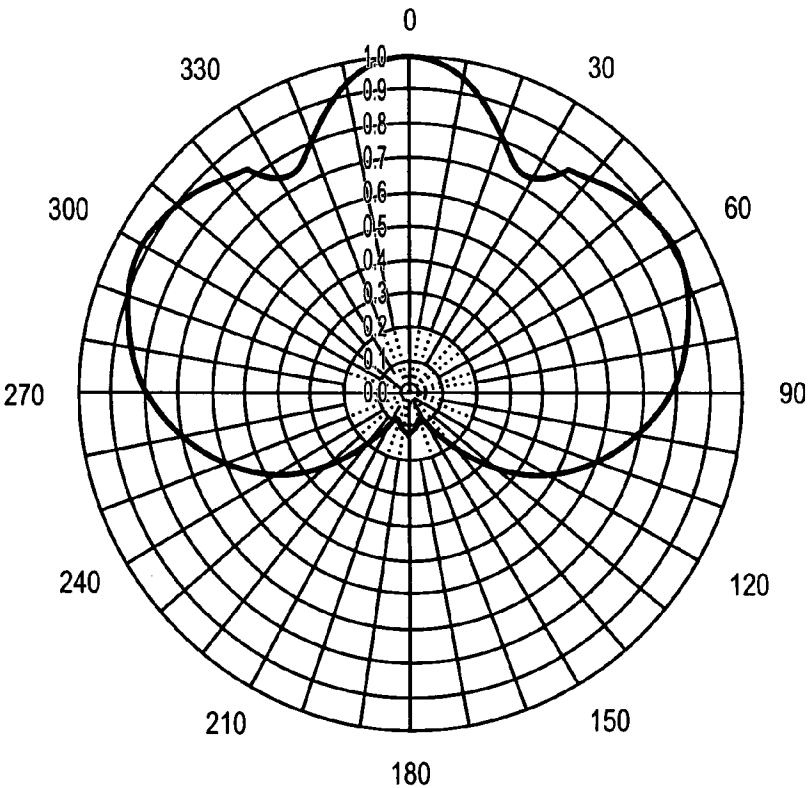
FIGS. 7A–7B illustrate another sample configuration of the exemplary antenna system and the resulting azimuthal pattern.
Figure 7A:
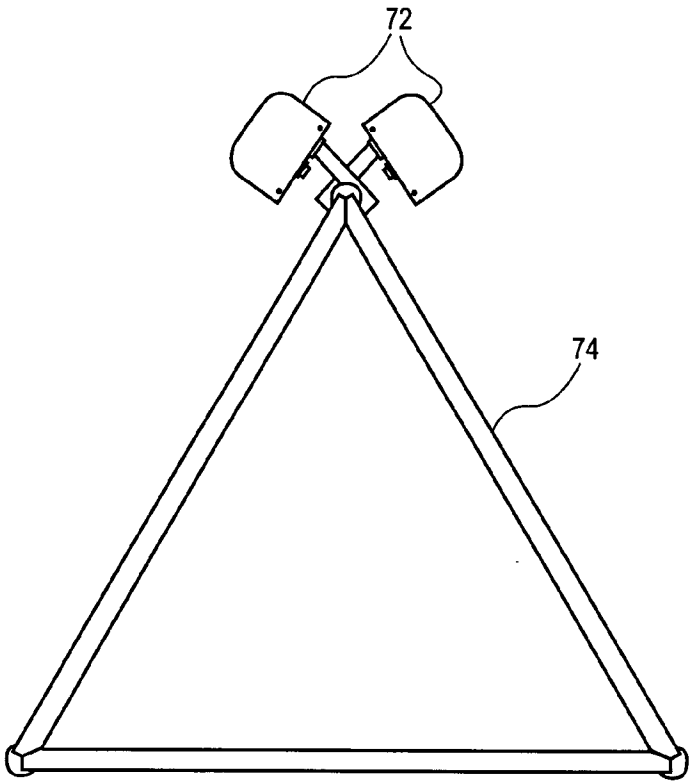

FIG. 7A is an illustration of two exemplary doublet panel antennas 72 vertically positioned on an edge of a tri-faced tower 74. The doublet panel antennas 72 are positioned approximately 90 degrees from each other.

FIG. 7B is an azimuthal pattern plot of the configuration of FIG. 7A. As can be seen from FIG. 7B, the pattern substantially covers the upper two quadrants of azimuth, the half-power beamwidth being approximately between 190 degrees and 210 degrees.

Figure 8B:
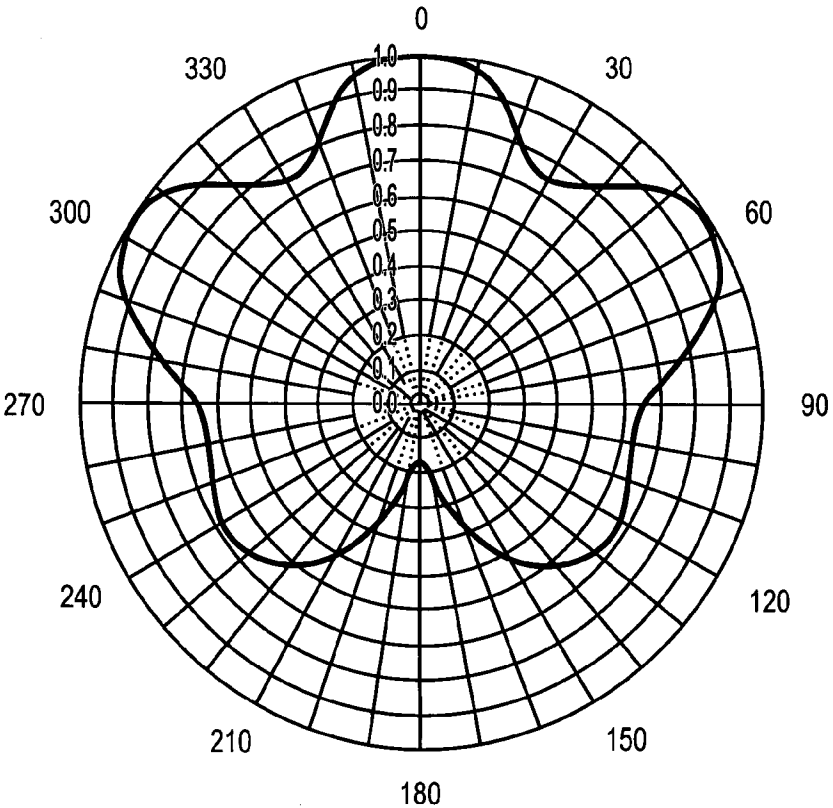
FIGS. 8A–8B illustrate another sample configuration of the exemplary antenna system and the resulting azimuthal pattern.
Figure 8A:
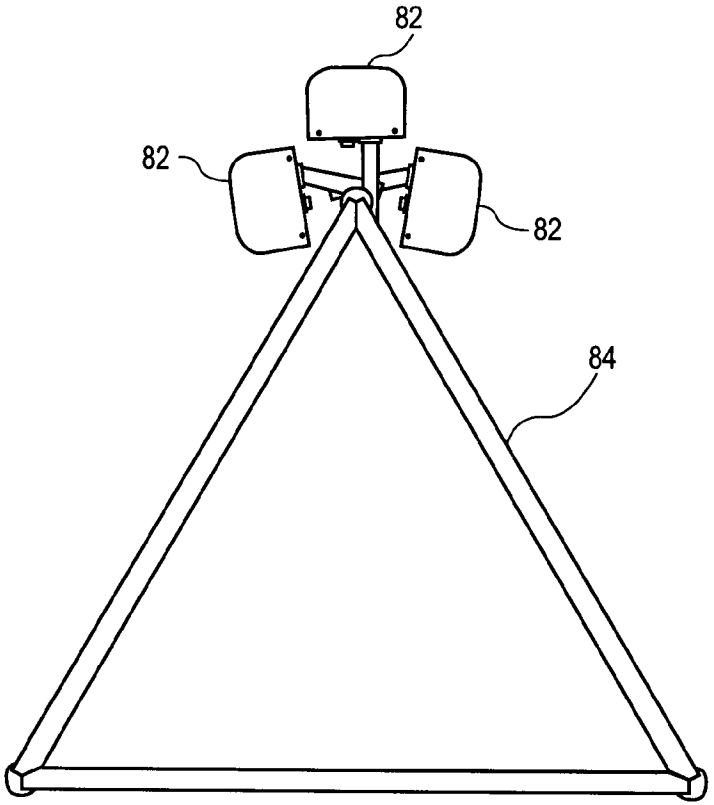

FIG. 8A is an illustration of three exemplary doublet panel antennas 82 vertically arranged on an edge of a tri-faced tower 84. The doublet panel antennas 82 are positioned approximately 80 degrees from each other.

FIG. 8B is an azimuthal pattern plot of the configuration of FIG. 8A. As can be seen from FIG. 8B, the pattern significantly covers more than the upper two quadrants of azimuth, and protrudes rearward to form a near star shaped pattern.

Figure 9B:
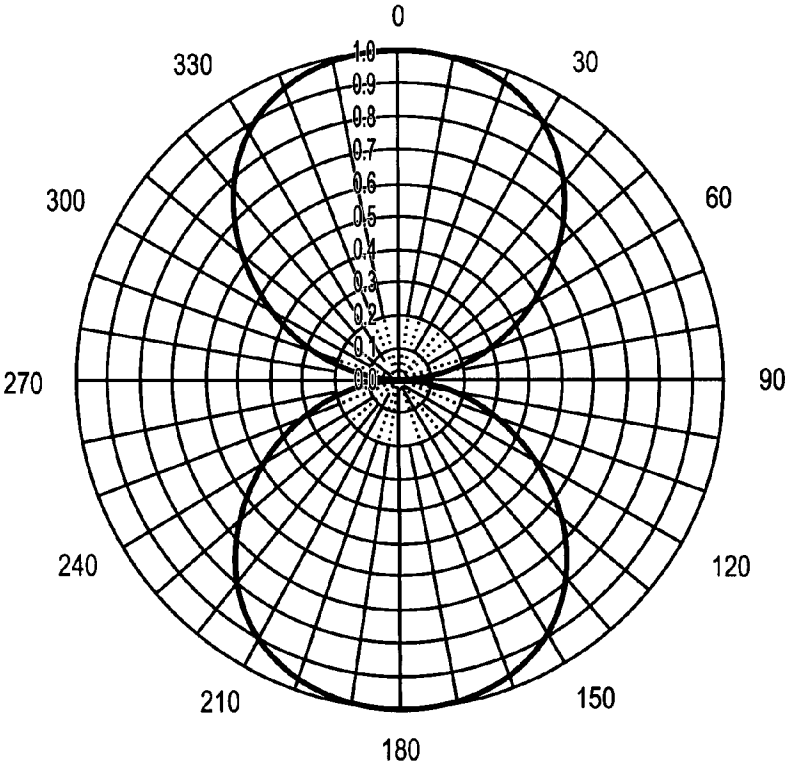
FIGS. 9A–9B illustrate another sample configuration of the exemplary antenna system and the resulting azimuthal pattern.
Figure 9A:
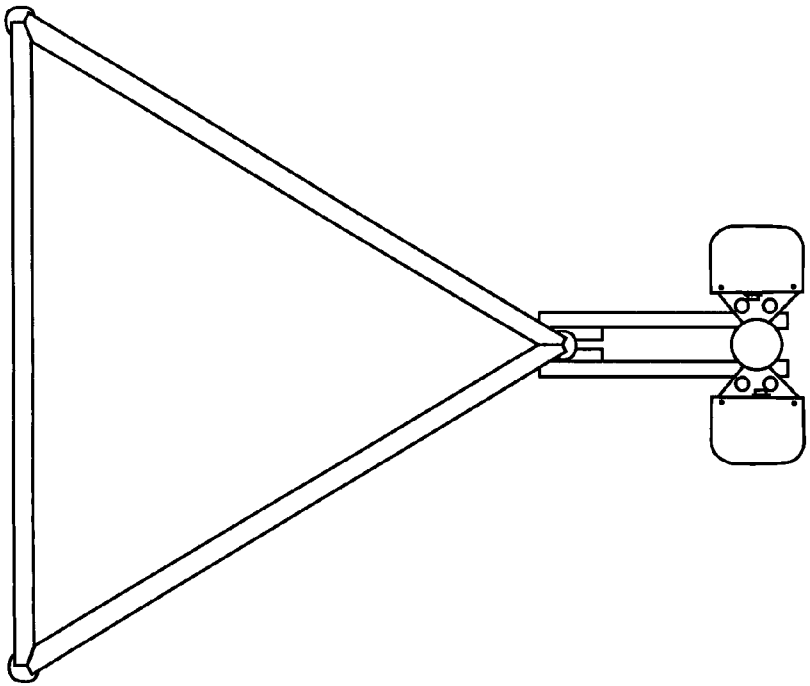

FIG. 9A is an illustration of two exemplary doublet panel antennas 92 vertically arranged on a corner of a tri-faced tower 94. The doublet panel antennas 92 are positioned at approximately 180 degrees from each other.

FIG. 9B is an azimuthal pattern plot of the configuration of FIG. 9A. The pattern plot is similar to the pattern plot provided in FIG. 6B, with the exception of the primary lobe being mirrored. The beamwidth of each lobe reflects an increase in azimuth of approximately 33 percent over conventional bow-tie slot panel antennas, similarly located on a tower.

Figure 10B:
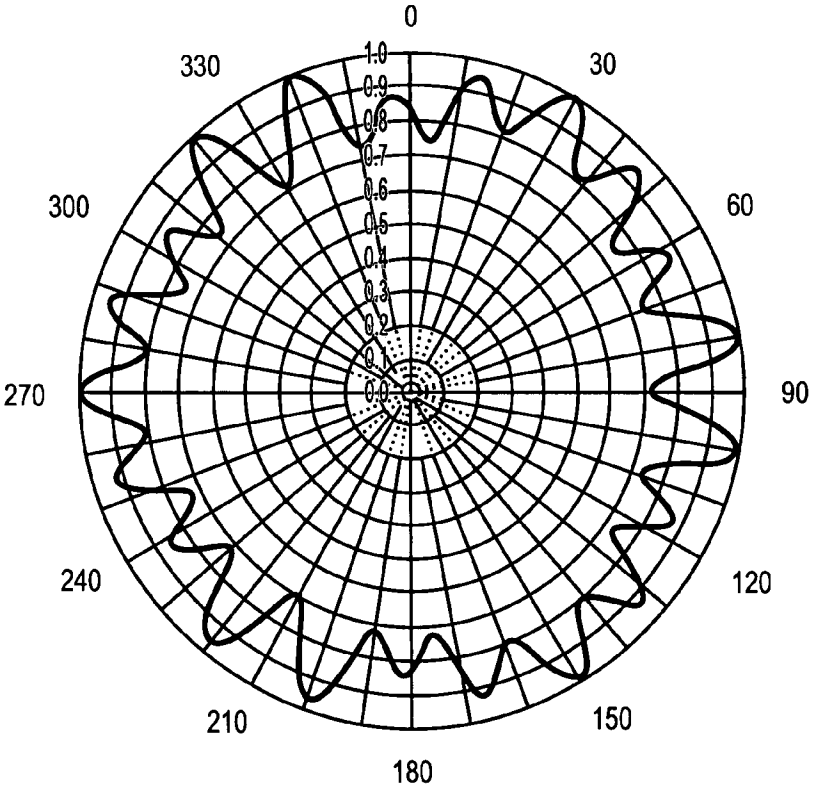
FIGS. 10A–10B illustrate another sample configuration of the exemplary antenna system and the resulting azimuthal pattern.
Figure 10A:
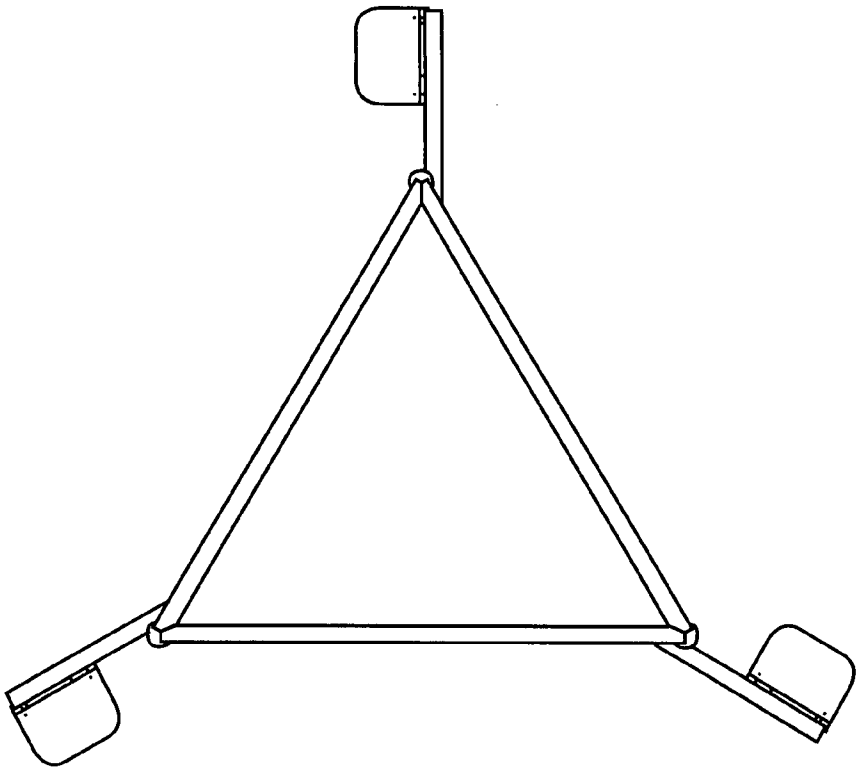

FIG. 10A is an illustration of three exemplary doublet panel antennas 102 vertically arranged off of each corner of a tri-faced tower 104. Each doublet panel antenna 102 is positioned at approximately 120 degrees from each other.

FIG. 10B is an azimuthal pattern plot of the configuration of FIG. 10A. The arrangement of the three doublet panel antennas 102 results in a substantially omni-directional pattern. Thus, by using only three exemplary doublet panel antennas 102, an omni-directional pattern can be produced.

Figure 11B:
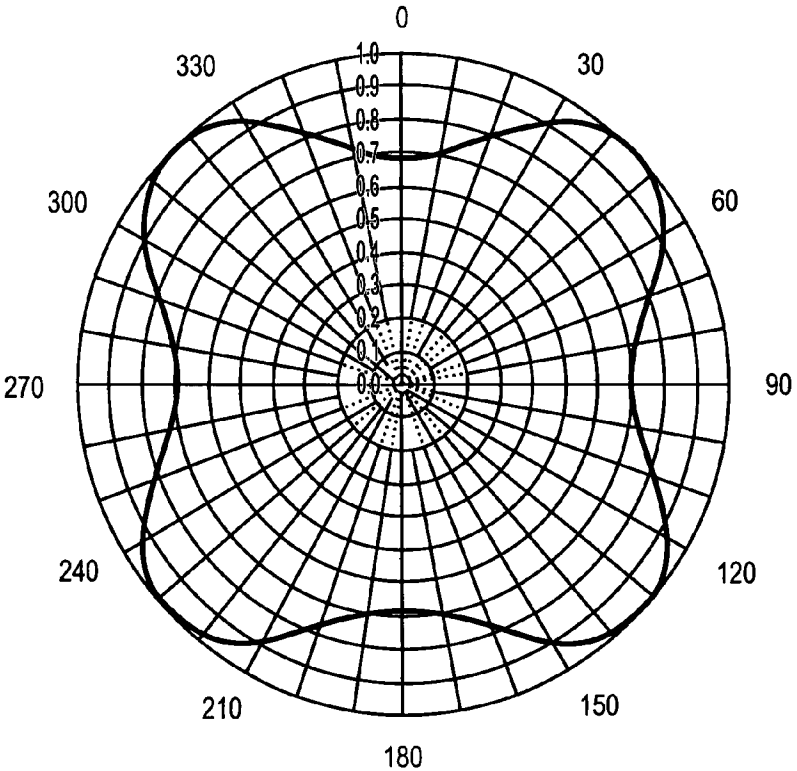
FIGS. 11A–11B illustrate another sample configuration of the exemplary antenna system and the resulting azimuthal pattern.
Figure 11A:
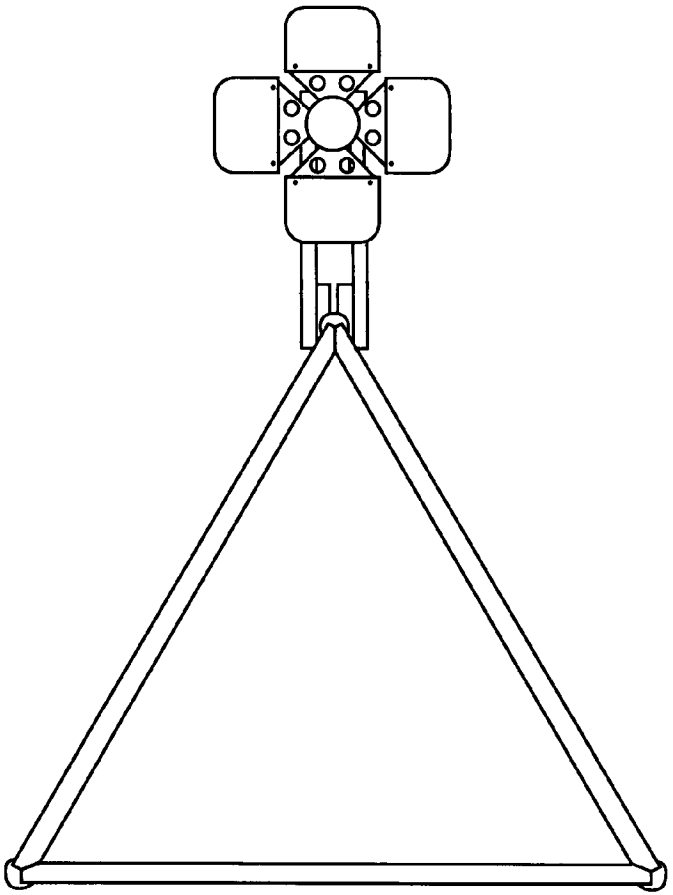

FIG. 11A is an illustration of four exemplary doublet panel antennas 112 vertically arranged about an edge of a tri-faced tower 114. The doublet panel antennas 112 are positioned at approximately 90 degrees from each other.

FIG. 11B is an azimuthal pattern plot of the configuration of FIG. 11A. The pattern is primarily omni-directional, however, superpositioning of fields from adjacent doublet panel antennas 112 is seen in the increased off-axis lobes, for example, at 45 degrees, 135 degrees, etc. As is apparent from comparing this pattern plot with that of FIG. 10B, both arrangements of doublet panel antennas result in a near omni-directional azimuthal pattern. However, as discussed above, the configuration of FIG. 10A requires one less antenna than the configuration of FIG. 11A.

It should be appreciated that, by stacking (e.g., layering) the exemplary panel antennas, the antenna configuration of FIG. 6A can be increased from a one layer main lobe peak gain of 9.3 dB to an eight layer main lobe peak gain of 18.6 dB. Likewise, the antenna configuration of FIGS. 8A and 10A can be increased from 6.3 dB (one layer) to 15.6 dB (eight layer) and 5.1 dB (one layer) to 14.2 dB (eight layer), respectively. Accordingly, by arranging the exemplary doublet antennas in the configurations shown in FIGS. 6–11, and by layering the exemplary antennas, a significant increase in gain, as well as omni-directional capability, can be acquired, with less antenna systems than conventionally thought possible.

It should be appreciated that, though the above figures illustrate the exemplary doublet panel antennas as being principally vertically oriented, they may be modified to be horizontally oriented. Therefore, the primary polarization of the field vectors emanating from the rotated slots 12 will be vertical. Consequently, the parasitic dipole 38, as explicitly shown in FIG. 2 as a vertical polarization generator, will operate as a horizontal polarization generator. Also, by preferential arrangement of the doublet panel antennas about a tower, varying frequencies and modalities can be implemented. For example, an antenna dedicated to a particular band of frequencies, (e.g., FM) may be implemented within an array configured for "other" particular frequencies, (e.g., non-FM). Therefore, a single tower may be configured with a series of antenna arrays to provide both FM and television broadcast signals, or other signals, as desired. Accordingly, while the exemplary embodiments of this invention are discussed in FIGS. 6–11 in the context of a 700 MHz low/high band system, alternative frequencies and ranges may be used, according to design preferences.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A slotted panel antenna, comprising:

at least one or more conductive panels having a bow-tie slot therein, wherein portions of the panels are folded to form a multi-angled panel, the junction formed by the folded portions of the panels with the non-folded portions of the panels being substantially parallel to a centerline of the bow-tie slot;

a substantially planar ground plane disposed behind the panels and coupled to a side of the bow-tie slot; and a stripline feed disposed between the panels and the ground plane, wherein the stripline feed is coupled to an opposite side of the bow-tie slot.

2. The antenna according to claim 1, further comprising:

a parasitic element disposed substantially parallel to and displaced from the bow-tie slot, and oriented at an angle that is skewed from an axis of symmetry of the bow-tie slot, wherein a midpoint of the parasitic element substantially crosses the axis of symmetry.

3. The antenna according to claim 2, wherein the parasitic element is a dipole.

4. The antenna according to claim 3, wherein a circularly polarized electromagnetic wave is generated.

5. The antenna according to claim 3, wherein an elliptically polarized electromagnetic wave is generated.

6. The antenna according to claim 1, wherein the stripline feed is coupled to the opposite side of the bow-tie slot via a substantially vertical conduit.

7. The antenna according to claim 1, wherein the ground plane is coupled to the portion of the bow-tie slot via a substantially vertical conduit.

8. The antenna according to claim 1, wherein the stripline is displaced from the ground plane by a non-conductive support.

9. The antenna according to claim 1, wherein the stripline is coupled to an external feed line via a stripline-to-feedline connection.

10. The antenna according to claim 9, wherein the external feed line is a coaxial line.

11. The antenna according to claim 1, wherein the dimensions of the bow-tie slot correspond to the radiation of frequencies between 700 MHz and 800 MHz.

12. The antenna according to claim 1, further comprising:

a radome.

13. The antenna according to claim 1, further comprising:

an antenna tower; and a broadcast transmitter.

14. A slotted panel antenna, comprising:

a folded radiating means for radiating a predominant first electromagnetic field orientation;

an unshielded excitation means for exciting currents on the folded radiating means;

a parasistic radiating means for radiating predominant second electromagnetic field orientation;

an imaging means for providing a ground plane effect; and a grounding means for providing a ground path from the folded radiating means to a ground, wherein the parasitic radiating means is disposed substantially parallel to and displaced from a front plane of the folded radiating means, and oriented at an angle that is skewed from an axis of symmetry of the folded radiating means and a midpoint of the folded radiating means substantially crosses the axis of symmetry, and the imaging means is disposed substantially parallel to the folded radiating means and on an opposite face of the folded radiating means from the parasitic radiating means.

15. The antenna according to claim 14, further comprising:

a protection means for protecting the antenna from physical elements.

16. The antenna according to claim 14, wherein the unshielded excitation means is coupled to the folded radiating means via a vertical transmission line.

17. The antenna according to claim 14, wherein the unshielded excitation means is coupled to a feedline coupling means for coupling energy from the feedline to the excitation means.

18. A method for broadcasting an electromagnetic signal comprising the steps of:

folding portions of a bow-tie slotted panel radiator to increase the beamwidth from the panel radiator;

placing a ground plane behind the radiators;

arranging the panel radiators about a tower; and exciting a first electromagnetic field from each of the folded slotted panel radiators via a stripline feedline.

19. The method according to claim 18, further comprising:

generating a second electromagnetic field orthogonal to the first electromagnetic field from a parasitic element off-axis from a centerline of the slots of the panel radiators, wherein the combination of the first and second fields produces a circularly polarized electromagnetic field.

20. The method according to claim 18, wherein the radiators are arranged to provide an omni-directional pattern.

* * * * *